US007696988B2

(12) United States Patent
Wu et al.

(10) Patent No.: US 7,696,988 B2
(45) Date of Patent: Apr. 13, 2010

(54) SELECTIVE USE OF LCD OVERDRIVE FOR REDUCING MOTION ARTIFACTS IN AN LCD DEVICE

(75) Inventors: Che Ming Wu, San Gabriel, CA (US); Vincent Wang, San Jose, CA (US); Cheen Doung, Cupertino, CA (US)

(73) Assignee: Genesis Microchip Inc., Santa Clara, CA (US)

( * ) Notice: Subject to any disclaimer, the term of this patent is extended or adjusted under 35 U.S.C. 154(b) by 960 days.

(21) Appl. No.: 10/874,849

(22) Filed: Jun. 22, 2004

(65) Prior Publication Data

US 2005/0225522 A1 Oct. 13, 2005

Related U.S. Application Data

(60) Provisional application No. 60/561,042, filed on Apr. 9, 2004.

(51) Int. Cl.
*G09G 5/00* (2006.01)

(52) U.S. Cl. ..... 345/204; 345/98; 345/690

(58) Field of Classification Search ..... 345/204, 345/98, 690

See application file for complete search history.

(56) References Cited

U.S. PATENT DOCUMENTS

| | | | | |
|---|---|---|---|---|
| 5,369,418 | A * | 11/1994 | Richards | 345/540 |
| 2005/0068343 | A1 * | 3/2005 | Pan et al. | 345/690 |
| 2005/0146495 | A1 * | 7/2005 | MacKinnon et al. | 345/98 |
| 2005/0162566 | A1 * | 7/2005 | Chuang et al. | 348/714 |
| 2005/0200631 | A1 | 9/2005 | Pan et al. | |
| 2005/0226324 | A1 | 10/2005 | Ouyang et al. | |
| 2006/0146066 | A1 | 7/2006 | Sasaki | |

OTHER PUBLICATIONS

U.S. Appl. No. 10/874,520, filed Jun. 22, 2004.

* cited by examiner

*Primary Examiner*—Richard Hjerpe
*Assistant Examiner*—Leonid Shapiro
(74) *Attorney, Agent, or Firm*—Beyer Law Group LLP; Lisa K. Jorgenson

(57) ABSTRACT

Selectively providing LC overdrive by determining a relative noise level between a current video frame and a previous video frame and overdriving the current video frame based upon the determined relative noise level.

20 Claims, 11 Drawing Sheets

OVERDRIVE TABLE

| | 0 | 32 | 64 | 96 | 128 | 160 | 192 | 224 | 255 |
|---|---|---|---|---|---|---|---|---|---|
| 0 | 0 | -20 | -38 | -55 | -75 | -100 | -126 | -149 | -167 |
| 32 | 80 | 32 | -6 | -23 | -43 | -68 | -94 | -117 | -135 |
| 64 | 153 | 120 | 64 | 21 | -11 | -36 | -62 | -85 | -103 |
| 96 | 194 | 174 | 141 | 96 | 46 | -4 | -30 | -53 | -71 |
| 128 | 229 | 214 | 195 | 167 | 128 | 72 | 5 | -21 | -39 |
| 160 | 259 | 250 | 236 | 217 | 192 | 160 | 92 | 31 | -7 |
| 192 | 291 | 282 | 275 | 264 | 247 | 226 | 192 | 149 | 94 |
| 224 | 323 | 314 | 307 | 296 | 281 | 270 | 255 | 224 | 195 |
| 255 | 354 | 345 | 338 | 327 | 312 | 301 | 286 | 270 | 255 |

FIG. 1

SELECTIVE USE OF LCD OVERDRIVE FOR REDUCING MOTION ARTIFACTS IN AN LCD DEVICE

BACKGROUND

1. Field of the Invention

The invention relates to display devices. More specifically, the invention describes a method and apparatus for enhancing the appearance of motion on an LCD panel display.

2. Overview

Each pixel of an LCD panel can be directed to assume a luminance value discretized to the standard set [0, 1, 2, . . . , 255] where a triplet of such pixels provides the R, G, and B components that make up an arbitrary color which is updated each frame time, typically $1/60^{th}$ of a second. The problem with LCD pixels is that they respond sluggishly to an input command in that the pixels arrive at their target values only after several frames have elapsed, and the resulting display artifacts—"ghost" images of rapidly moving objects—are disconcerting. Ghosting occurs when the response speed of the LCD is not fast enough to keep up with the frame rate. In this case, the transition from one pixel value to another cannot be attained within the desired time frame since LCDs rely on the ability of the liquid crystal to orient itself under the influence of an electric field. Therefore, since the liquid crystal must physically move in order to change intensity, the viscous nature of the liquid crystal material itself contributes to the appearance of ghosting artifacts.

In order to reduce and/or eliminate this deterioration in image quality, the LC response time is reduced by overdriving the pixel values such that a target pixel value is reached, or almost reached, within a single frame period. In particular, by biasing the input voltage of a given pixel to an overdriven pixel value that exceeds the target pixel value for the current frame, the transition between the starting pixel value and target pixel value is accelerated in such a way that the pixel is driven to the target pixel value within the designated frame period. In order to calculate an overdrive voltage for a particular frame, the overdrive algorithm stores previous frame data (in a non-recursive type algorithm) or predicted frame data (in a recursive type algorithm) in a memory device (such as a SDRAM). Incoming frame data is then compared with the stored frame data and the overdrive values are calculated. The new calculated overdrive data will then be output as new data display on the LCD and the stored frame data (in SDRAM) is updated by the previous frame data (non-recursive) or predicted frame data (recursive).

Unfortunately, however, by improving the response time of the LCD panel, the overdrive technique also allows low-level noise (typically calculated as a difference between observed luminance values between adjacent video frames, or portions thereof) that would otherwise not be visible to become perceptible on the LCD panel as image artifacts. Such noise may appear as a rippling effect in static fields or jitter associated with even slowly moving objects. This is due, in part, to the fact that a by decreasing the response time of the LCD panel, the low-level noise artifacts are preferentially enhanced.

Therefore what is required is a method, system, and apparatus for selectively applying an LCD overdrive techniques that avoids enhancing low level noise artifacts.

SUMMARY OF THE DISCLOSURE

What is provided is a reduced memory method, apparatus, and system suitable for implementation in Liquid Crystal Display (LCDs) that reduces a pixel element response time thereby enabling the display of high quality fast motion images thereupon.

In one embodiment, a method of selectively providing LC overdrive is described. The method is carried out by determining a relative noise level between a current video frame and a previous video frame and overdriving the current video frame, or not, based upon the determined relative noise level.

In another embodiment, a reduced memory method of selectively providing LC overdrive in an LCD device is described that generates a predicted pixel value and compresses the predicted pixel value and stores the compressed predicted pixel value. The stored compressed pixel value is then retrieved and decompressed as a start pixel value which is compared to the target pixel value to form a difference between the decompressed pixel value and the target pixel value and based on the comparing generates an overdrive pixel value based upon a target pixel value and the start pixel value such that the overdrive pixel value enables a pixel to reach the target pixel value within a single frame period.

In another embodiment, a reduced memory system for selectively providing LC overdrive in an LCD device is described that includes an LCD overdrive unit arranged to provide an overdrive pixel value based upon a start pixel value and a target pixel value for display on the LCD device, a data compression unit for compressing selected pixel data, a delay device arranged to delay the compressed pixel data at least one frame period in relation to a subsequent video frame, and a decompressor unit for decompressing the delayed compressed pixel data as the start pixel data.

In still another embodiment, computer program product for providing a reduced memory method of selectively providing LC overdrive in an LCD device is described. The computer program product includes computer code for generating a predicted pixel value, computer code for compressing the predicted pixel value, computer code for storing the compressed predicted pixel value, computer code for retrieving the compressed pixel value, computer code for decompressing the compressed pixel value as a start pixel value, computer code for generating an overdrive pixel value based upon a target pixel value and the start pixel value such that the overdrive pixel value enables a pixel to reach the target pixel value within a single frame period. The computer code is, in turn, stored in a computer readable medium.

BRIEF DESCRIPTION OF THE DRAWINGS

FIG. 1 shows an exemplary overdrive table.

FIG. 6 shows a flowchart detailing a process for providing a reduced memory LCD overdrive in accordance with an embodiment of the invention.

DETAILED DESCRIPTION OF SELECTED EMBODIMENTS

Reference will now be made in detail to a particular embodiment of the invention an example of which is illustrated in the accompanying drawings. While the invention will be described in conjunction with the particular embodiment, it will be understood that it is not intended to limit the invention to the described embodiment. To the contrary, it is intended to cover alternatives, modifications, and equivalents as may be included within the spirit and scope of the invention as defined by the appended claims.

Figure 2:
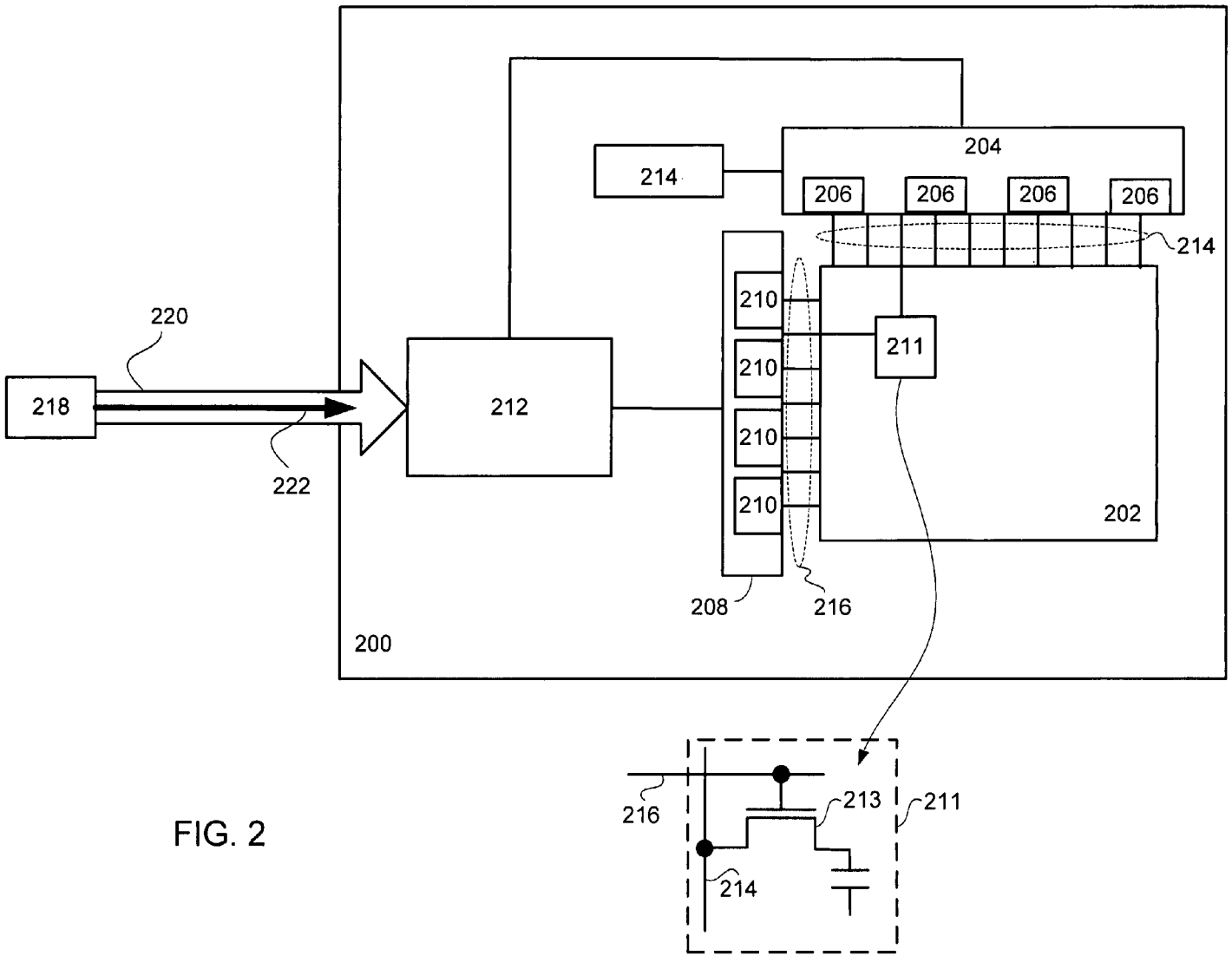
FIG. 2 is a block diagram showing an example of an active matrix liquid crystal display device suitable for use with any embodiment of the invention.

What follows is a brief description of an active matrix LCD panel suitable for use with any embodiment of the invention. Accordingly, FIG. 2 is a block diagram showing an example of an active matrix liquid crystal display device 200 suitable for use with any embodiment of the invention. As shown in FIG. 2, the liquid crystal display device 200 is formed of a liquid crystal display panel 202, a data driver 204 that includes a number of data latches 206 suitable for storing image data, a gate driver 208 that includes gate driver logic circuits 210, a timing controller unit (also referred to as a TCON) 212, and a reference voltage power supply 214 that generates a reference voltage Vref that is applied to the liquid crystal display panel 202 as well as a number of predetermined voltages necessary for operations of the data driver 204 and the gate driver 208.

The LCD panel 202 includes a number of picture elements 211 that are arranged in a matrix connected to the data driver 204 by way of a plurality of data bus lines 214 and a plurality of gate bus lines 216. In the described embodiment, these picture elements take the form of a plurality of thin film transistors (TFTs) 213 that are connected between the data bus lines 214 and the gate bus lines 216. During operation, the data driver 204 outputs data signals (display data) to the data bus lines 214 while the gate driver 208 outputs a predetermined scanning signal to the gate bus lines 216 in sequence at timings which are in sync with a horizontal synchronizing signal. In this way, the TFTs 213 are turned ON when the predetermined scanning signal is supplied to the gate bus lines 216 to transmit the data signals, which are supplied to the data bus lines 214 and ultimately to selected ones of the picture elements 211.

Typically, the TCON 212 is connected to a video source 218 (such as a personal computer, TV or other such device) suitably arranged to output a video signal (and, in most cases, an associated audio signal). The video signal can have any number and type of well-known formats, such as composite, serial digital, parallel digital, RGB, or consumer digital video. When the video signal takes the form of an analog video signal, then the video source 218 includes some form of an analog video source such as for example, an analog television, still camera, analog VCR, DVD player, camcorder, laser disk player, TV tuner, set top box (with satellite DSS or cable signal) and the like. In those cases where the video signal is a digital video signal, then the video source 218 includes a digital image source such as for example a digital television (DTV), digital still camera or video camera, and the like. The digital video signal can be any number and type of well known digital formats such as, SMPTE 274M-1995 (1920×1080 resolution, progressive or interlaced scan), SMPTE 296M-1997 (1280×720 resolution, progressive scan), as well as standard 480 progressive scan video.

Typically, the video signal provided by the video source 218 is taken to be a digital video signal consistent with what is referred to as RGB color space. As well known in the art, the video signals RGB are three digital signals (referred to as "RGB signal" hereinafter) formed of an "R" signal indicating a red luminance, a "G" signal indicating a green luminance, and a "B" signal indicating a blue luminance. The number of data bits associated with each constituent signal (referred to as the bit number) of the RGB signal is often set to 8 bit, for a total of 24 bits but, of course, can be any number of bits deemed appropriate.

Figure 3:
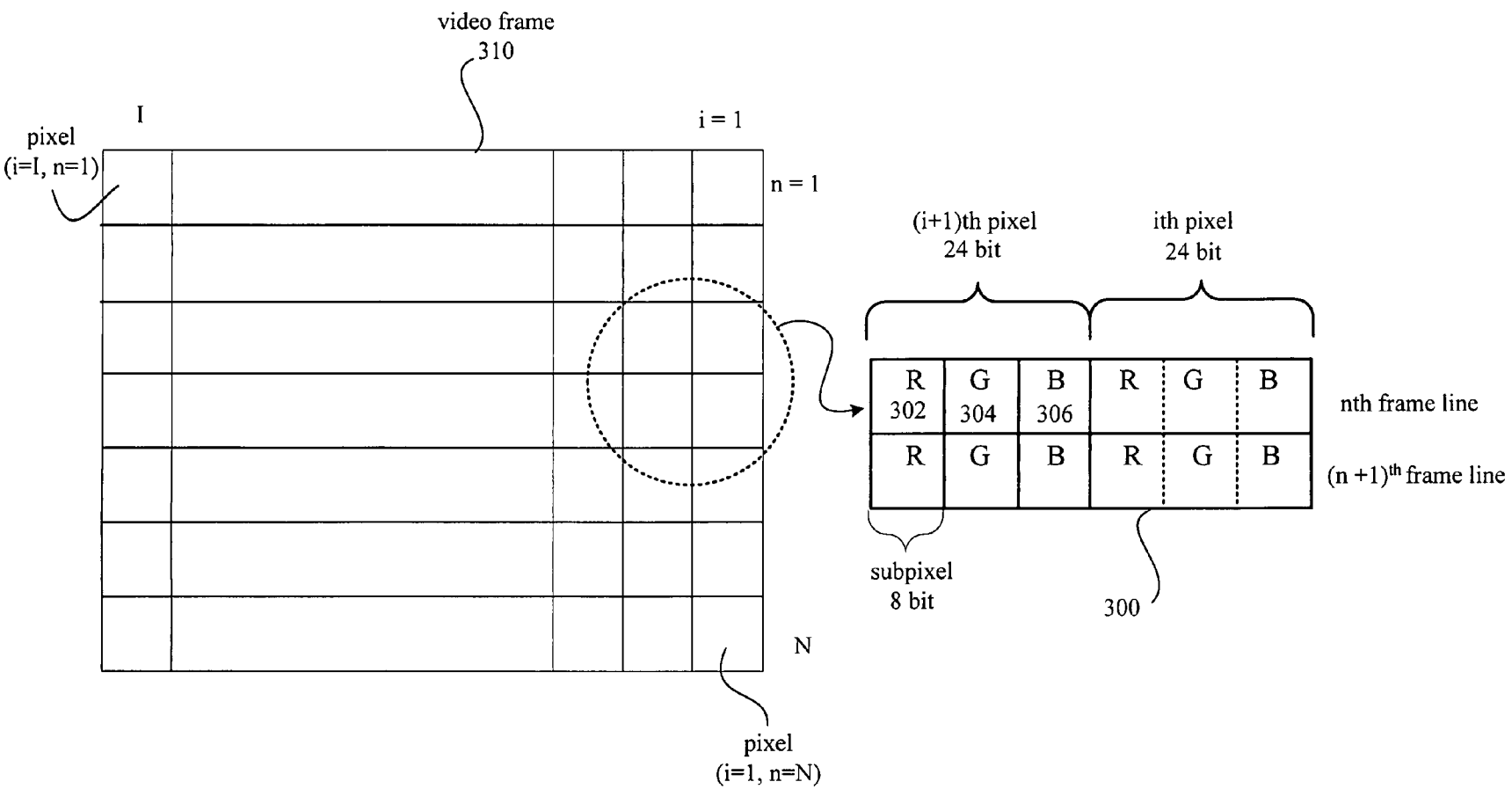
FIG. 3 shows a representative pixel data word in accordance with the invention.

For the remainder of this discussion, it will be assumed that the video signal provided by the video source 218 is digital in nature formed of a number of pixel data words each of which provides data for a particular pixel element. For this discussion, it will be assumed that each pixel data word includes 8 bits of data corresponding to a particular one of the color channels (i.e., Red, Blue, or Green). Accordingly, FIG. 3 shows a representative pixel data word 300 in accordance with the invention. The pixel data work 300 is shown suitable for an RGB based 24 bit (i.e., each color space component R, G, or B, is 8 bits) system. It should be noted, however, that although an RGB based system is used in the subsequent discussion, the invention is well suited for any appropriate color space. Accordingly, the pixel data word 300 is formed of 3 sub-pixels, a Red® sub-pixel 302, a Green (G) sub-pixel 304, and a Blue (B) sub-pixel 306 each sub-pixel being 8 bits long for a total of 24 bits. In this way, each sub-pixel is capable of generating 28 (i.e., 256) voltage levels referred to hereinafter as pixel values. For example, the B sub-pixel 306 can be used to represent 256 levels of the color blue by varying the transparency of the liquid crystal which modulates the amount of light passing through an associated blue mask whereas the G sub-pixel 304 can be used to represent 256 levels of the color green in substantially the same manner. It is for this reason that conventionally configured display monitors are structured in such a way that each display pixel is formed in fact of the 3 sub-pixels 302-306 which taken together form approximately 16 million displayable colors. Using an active matrix display, for example, a video frame 310 having N frame lines each of which is formed of I pixels, a particular pixel data word can be identified by denoting a frame line number n (from 1 to N) and a pixel number i (from 1 to I).

Referring back to FIG. 2, during the transmission of a video image in the form of a video frame, the video source 218 provides a data stream 222 formed of a number of pixel data words 300. The pixel data words 300 are then received and processed by the TCON 212 in such a way that all the video data (in the form of pixel data) used for the display of a particular frame line n of the video frame 310 must be provided to the data latches 206 within a line period $\tau$. Therefore, once each data latch 206 has a corresponding pixel data stored therein, is the data driver 204 is selected in such a way to drive appropriate ones of the TFTs 213 in the LCD array 202.

In order to improve the performance of slow LCD panels, the performance of the LCD panel is first characterized by, for example, taking a series of measurements that show what each pixel will do by the end of one frame time. Such measurements are taken for a representative pixel (or pixels) each being initially at a starting pixel value s that is then commanded toward a target value t (where s and t each take on integer values from 0 to 255). If the pixel value actually attained in one frame time is p, then $$p=f_s(t) \tag{1}$$

where $f_s$ is the one-frame pixel-response function corresponding to a fixed start-pixel s. For example, the one-frame pixel response function $f_s(t)$ for a pixel having a start pixel value s=32 and a target pixel value t=192 that can only reach a pixel value p=100 is represented as $f_{32}(192)=100$.

For slow panels (where most if not all targets can not be reached within a frame time) functions m(s) and M(s) give the minimum pixel value and maximum pixel value, respectively, reachable in one frame time as functions of s that define maximum-effort curves. Therefore, in order to reach a pixel value p that lies within the interval [m(s), M(s)], equation (1) is solved for the argument that produces pixel value p referred to as the overdrive pixel value that will achieve the goal (i.e., pixel value p) in one frame time.

Figure 4:
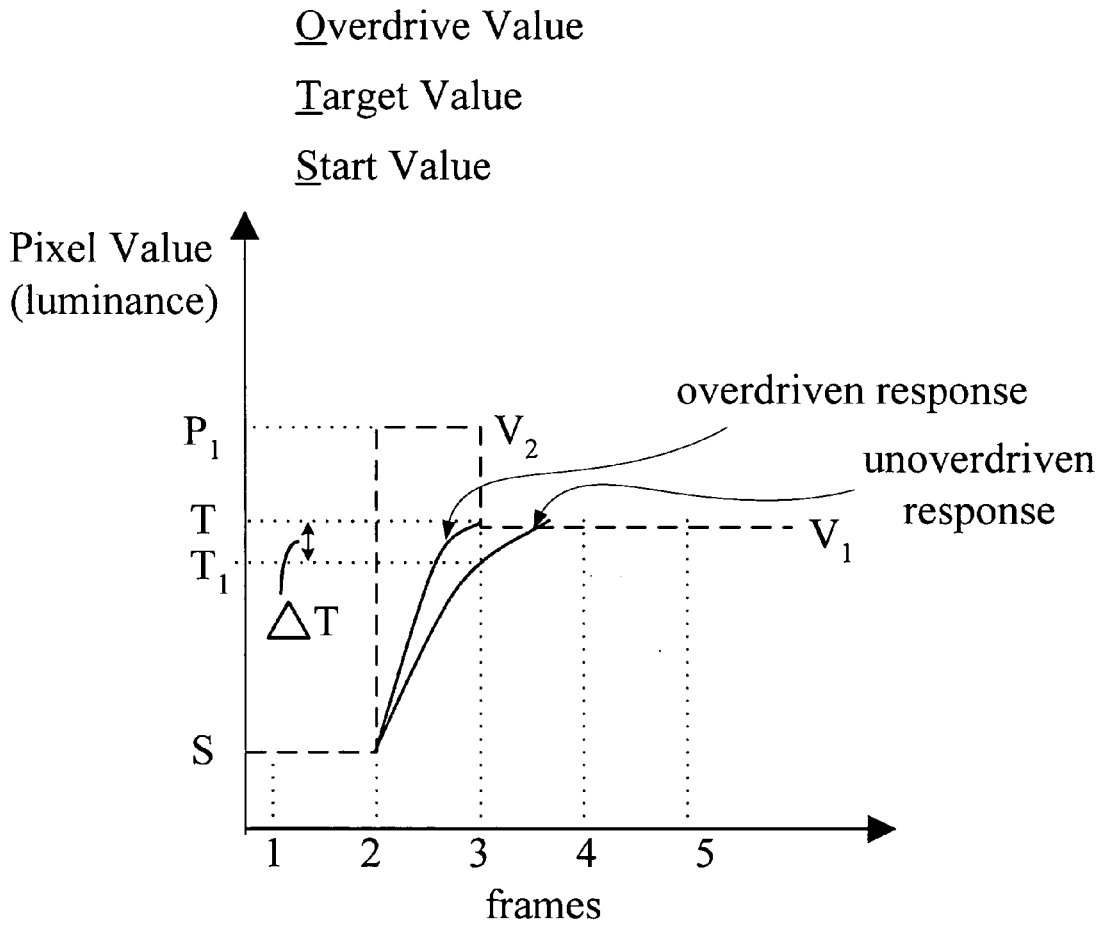
FIG. 4 shows a comparison between an unoverdriven pixel response curve and an overdriven pixel response curve in accordance with an embodiment of the invention.

For example, FIG. 4 shows a comparison between an unoverdriven pixel response curve and an overdriven pixel response curve in accordance with an embodiment of the invention. In the example shown in FIG. 4, the pixel in question has a start pixel value S at the beginning of a frame 2 and a target pixel value T at the beginning of a next frame 3. However, when the pixel is not overdriven (i.e., a voltage $V_1$ is applied consistent with the target pixel value T), the pixel value achieved $T_1$ falls short of the target pixel value T by a value ΔT resulting in a ghosting artifact in subsequent frames. However, when the pixel is overdriven by applying a voltage $V_2>V_1$ consistent with an overdriven pixel value $p_1$, the target pixel value T is reached within the frame period 2 thereby eliminating any ghosting artifacts in subsequent frames.

It should be noted that the overdrive method requires a timely and accurate characterization of the LCD panel's optical response. An accurate model allows the overdrive to more accurately predict the response of a given pixel to an applied pixel value thereby allowing a more accurate selection of overdriven value and predicted pixel values. Since LCD panel response is affected by temperature, a long warm up time was used in order to ensure that the optical responses generated through this procedure were consistent. LCD optical response is temperature dependent. This is the case since the viscosity of the liquid crystal material is also dependent on temperature. The liquid crystals must physically rotate and thus its viscosity determines how quickly this rotation can take place. It is the speed of this rotation that determines the response time of a given LCD panel. In general, as the temperature increases, the viscosity of the liquid crystal decreases, thus decreasing the optical response time.

Using any of a number of non-inertial approaches (i.e., one that ignores pixel velocity) it is possible to create what is referred to as a Full Overdrive Table (FOT) that shows, for each starting pixel and each target pixel, the command pixel that will most-likely cause the target pixel value to be achieved at the end of one frame time. In the described embodiment, the FOT is formed of a lookup table with 256 columns—one for each starting pixel in the range 0 to 255—and likewise 256 rows, one for each possible target. While the FOT solves the runtime problem by simple lookup, it isn't practical to store a table of that size (256×256). However, by sub-sampling the pixel array at every $32^{nd}$ pixel, for example, using a reference sequence:

$$\text{pix}=\{0, 32, 64, 96, 128, 160, 192, 224, 255\} \tag{2}$$

in which the last entry is truncated to 255, a smaller 9×9 array referred to as an extended overdrive table (EOT) that uses the saturation regions to store useful data is formed. In this way, the extended overdrive table reduces the size of any interpolation errors when straddling crossover points to acceptable levels without requiring storing or using any crossover data. FIG. 1 shows an exemplary overdrive table 100 configured in such a way that a start pixel is given by column j and a target pixel by row i. It should be noted that the overdrive table 100 is provides is a sub-sampled overdrive table having a reduced number of table entries in order to preserve both computational and memory resources. Accordingly, the table 100 provides only those data points that result from "sub-sampling" of a full overdrive table (not shown) having 256×256 entries, one for each combination of start and target pixel. Since the table 100 is based upon a 32-pixel-wide grid (i.e., {0, 32, 64, 96, 128, 160, 192, 224, 255}), there are a number of "missing" rows and columns corresponding to the data points that fall outside of the sampling grid that are estimated at runtime based on any of a number of well known interpolation schemes.

Accordingly, the overdrive function corresponding to the overdrive table (such as that shown in FIG. 1) for fixed start pixel s is given as equation 3, $$G_s(p)=\begin{cases} p-m(s), & p<m(s) \\ f_s^{-1}(p), & m(s)\le p\le M(s) \\ 255+(p-M(s)), & p>M(s) \end{cases} \tag{3}$$

where the difference δ(p)=p−M(s) is a measure of the shortfall from the target pixel p; referred to as a deficit δ(p). There is no deficit (δ=0) in the unsaturated region, but the deficit becomes positive and grows by one pixel for each pixel further that the target p proceeds past the maximum M(s). In the EOT, the deficit is added to the saturation value of 255. At the low end the deficit is negative: then the deficit δ(p)=p−m(s) to again reflect the idea that the deficit is the difference between what we the target pixel value and the achieved pixel value, only here the target p is smaller than the minimum achieved. Accordingly, the deficit is added to the saturation value, which in this case is 0.

Figure 5:
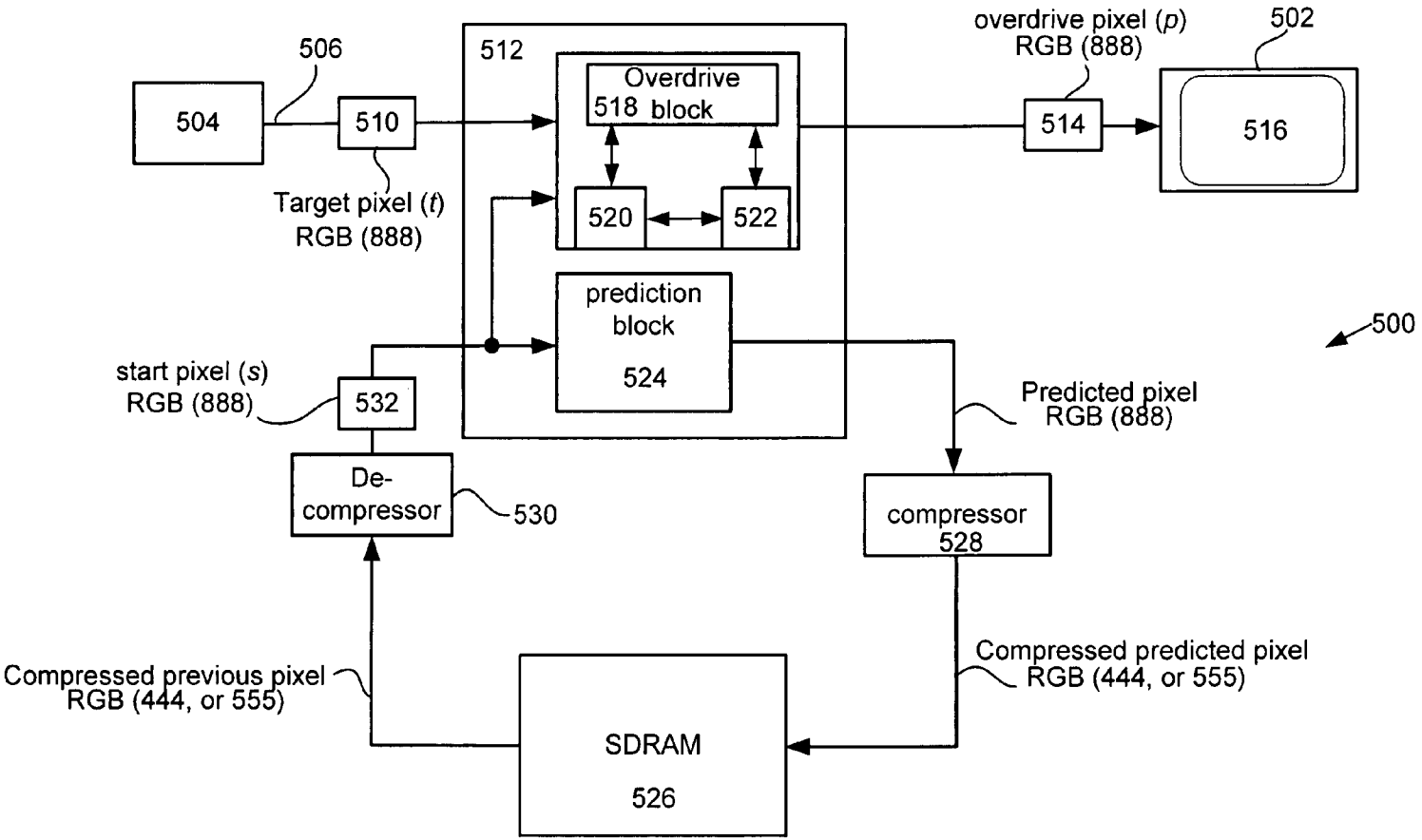
FIG. 5 shows a system having reduced memory requirements for displaying a motion enhanced image on an LCD in accordance with an embodiment of the invention.

Therefore, FIG. 5 shows a system 500 having reduced memory requirements for displaying a motion enhanced image on an LCD 502 in accordance with an embodiment of the invention. It should be noted, that the system 500 can be used in any number of applications but is most suitable for displaying images prone to exhibiting motion artifacts such as those that include fast motion. The system 500 includes a video source 504 arranged to provide a digital video stream 506 (representative of a number of video frames) formed of a number of data words along the lines described with reference to FIG. 3. As part of a current video frame, an uncompressed target pixel 510 (e.g., RGB (888)) is input to an LCD overdrive unit 512 configured to provide an uncompressed overdrive pixel 514 (i.e., RGB (888)) to the LCD 502 for eventual display on a display screen 516.

In the described embodiment, the overdrive unit 512 includes an overdrive block 518 coupled to an overdrive table 520 (which in this case is implemented as a ROM look up table, or LUT). In those cases where the overdrive table 520 is a sub-sampled type overdrive table, an interpolator unit 522 that "reads between the lines" of the overdrive table 520 provides the requisite overdrive pixel value (p) associated with the overdrive pixel 514 when one or the other of the values of a start pixel value (s) associated with a previous video frame and a target pixel value (t) associated with the current video frame are not one of the enumerated overdrive table pixel values (such as those of reference sequence (2) above).

A prediction block 524 is used to generate a predicted pixel value (pv) that corresponds to the actual brightness of the overdriven video frame 514 that is displayed by the LCD 502. In this way, any errors in the observed brightness level that can become a problem when a given target value (t) is not obtainable in one frame can be eliminated. Since the prediction block 524 effectively predicts the amount of any overshoot that occurs in the overdrive pixel value (p), the starting value of the subsequent video frame start value (s) can be adjusted accordingly based on the predicted pixel value pv corresponding to the currently displayed video frame. In this way, any overshoot can then be corrected in the subsequent video frame.

However, in order to provide the basis for adjusting the subsequent start pixel value, the predicted pixel value (pv) must be provided concurrently with the arrival of the current pixel value (i.e., the next video frame). This delay can be accomplished by storing the predicted pixel value (pv) in a memory unit 526 that typically takes the form of a SDRAM type memory unit. However, in order to preserve memory resources (i.e., both memory size and memory speed), a compressor unit 528 compresses (i.e., reduces the size of the data word) corresponding to the predicted pixel. This compression can take any form, such as bit truncation where selected data bits (Least Significant Bits, or LSB for example) are dropped or another compression technique referred to as rounding. In any case, the size of the data word is reduced from the original full length to a shorter length. For example, the compression can result in reducing the size of the data word from one consistent with RGB888 to one consistent with RGB444 or RGB555 or any other appropriate size. In this way, data compression can be used thereby requiring smaller memory size and fewer data pins of external SDRAM resulting in substantial cost savings.

Once the reduced size predicted pixel data is stored in the memory unit 528, it is then made available as the previous pixel data that corresponds to the start pixel value (s) for the current video frame. Therefore, a de-compressor unit 530 coupled between an output port of the memory unit 528 and an input of the overdrive unit 508 increases the size of the reduced data word back to the original data length (such as RGB888). In this way, the overdrive unit 508 can successfully provide the most accurate overdrive pixel value (p).

Figure 6:
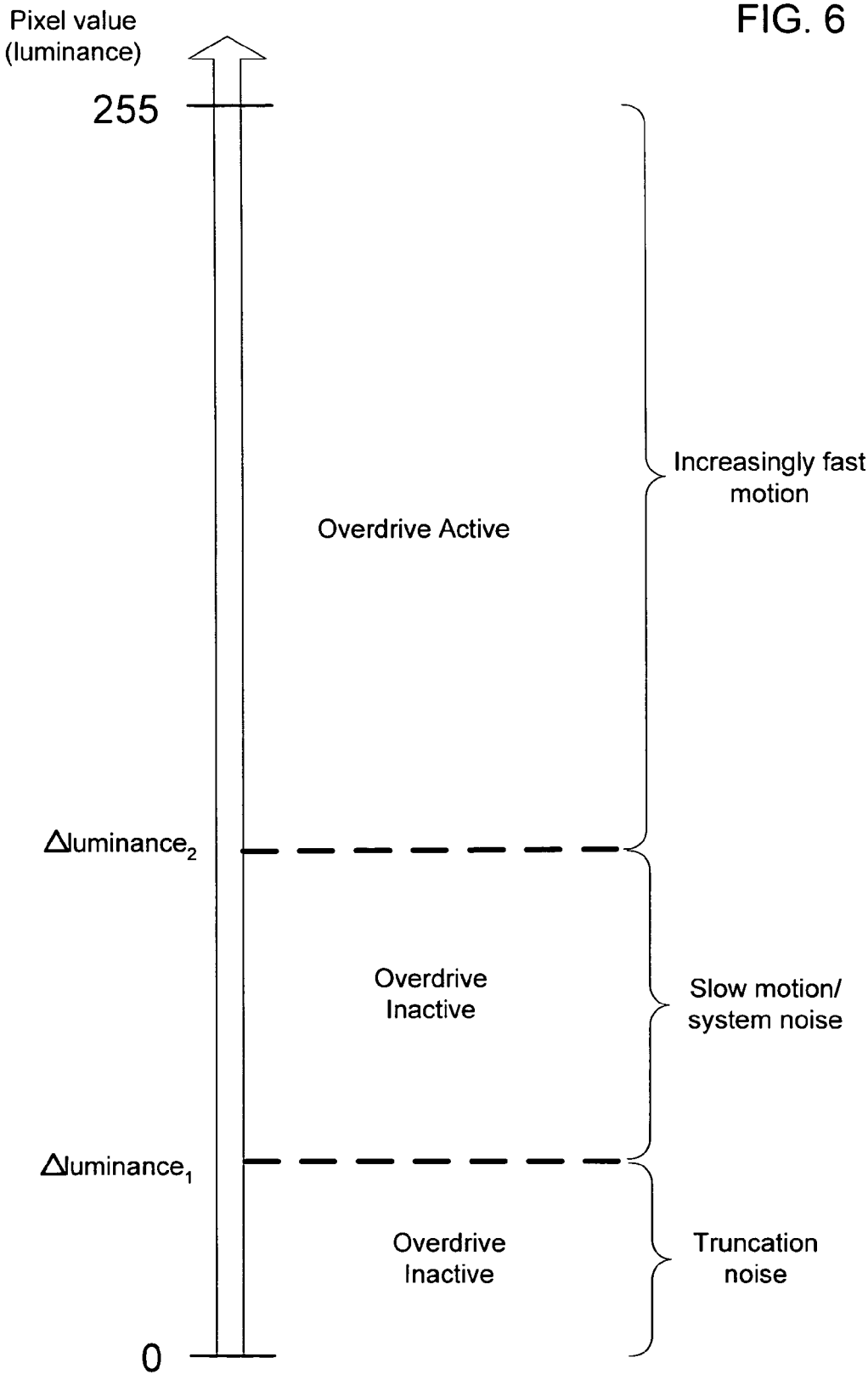
FIG. 6 shows relative noise levels for adjacent video frames.
Figure 7:
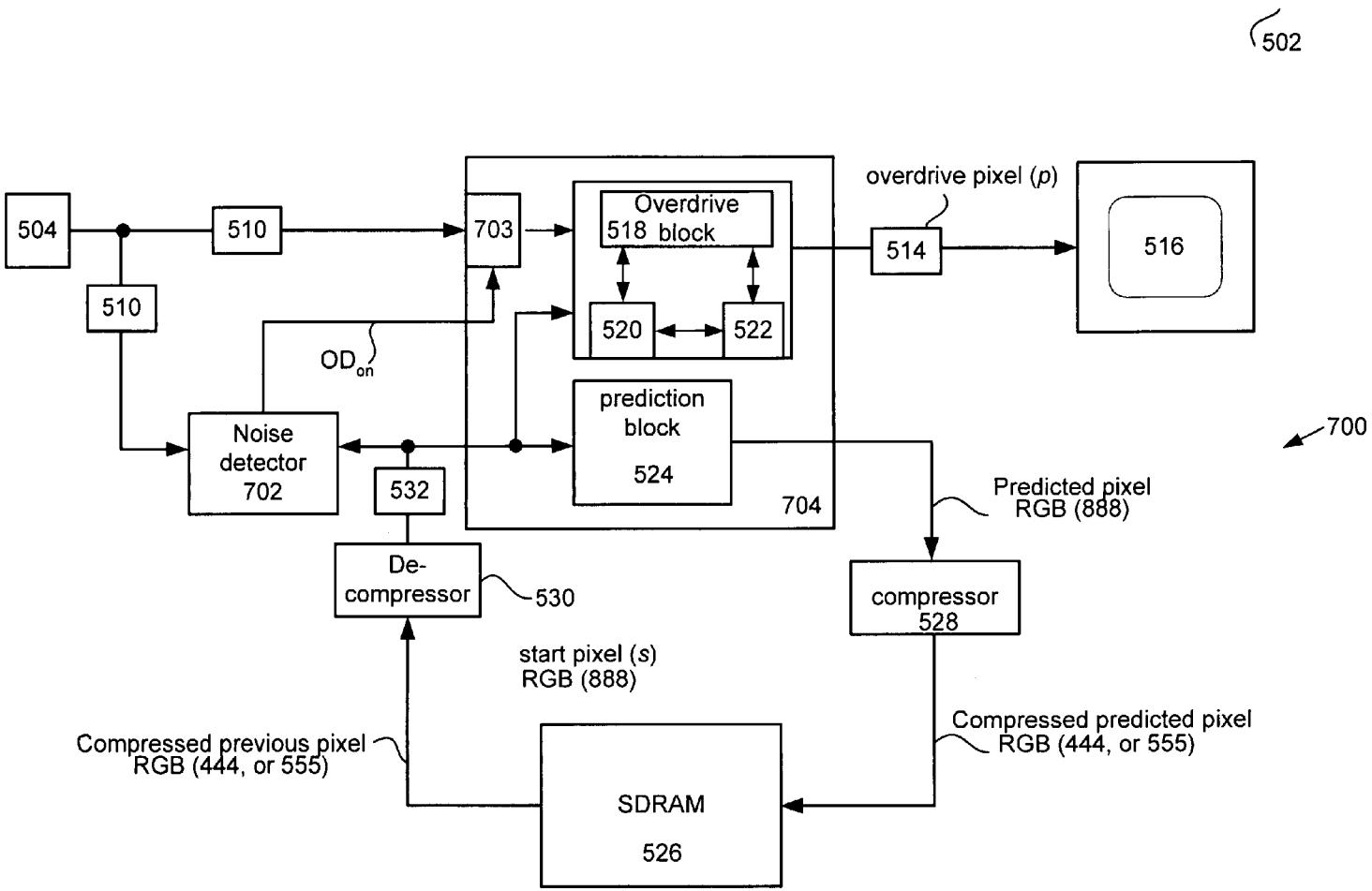
FIGS. 7-8 illustrate a system employed to implement the invention.

In some cases, however, the compression process can produce low level noise (as illustrated in FIG. 6 showing relative noise levels for adjacent video frames) that can cumulatively cause unwelcome display artifacts (such as "pixel boiling" in static scenes). Accordingly, in another embodiment of the invention as shown in FIG. 7, a system 700 having a noise level detector 702 coupled between the decompressor unit 530 and the LCD overdrive block 518 that detects a relative noise level (such at those shown in FIG. 6) between the current target pixel value 510 and the adjusted start pixel value 532. Based upon the detected relative noise level, a signal OD is generated and input to a switch unit 703 coupled to or incorporated in an overdrive block 704. In those cases where the detected relative noise level is greater than a predetermined threshold level (similar to those shown in FIG. 6) indicating a high probability of fast motion, then an overdrive signal $OD_{on}$ directs the switch unit 703 to route the target pixel 510 to the overdrive block 518 for processing which, in turn, provides the overdrive pixel 514 to the display 516.

Figure 8:
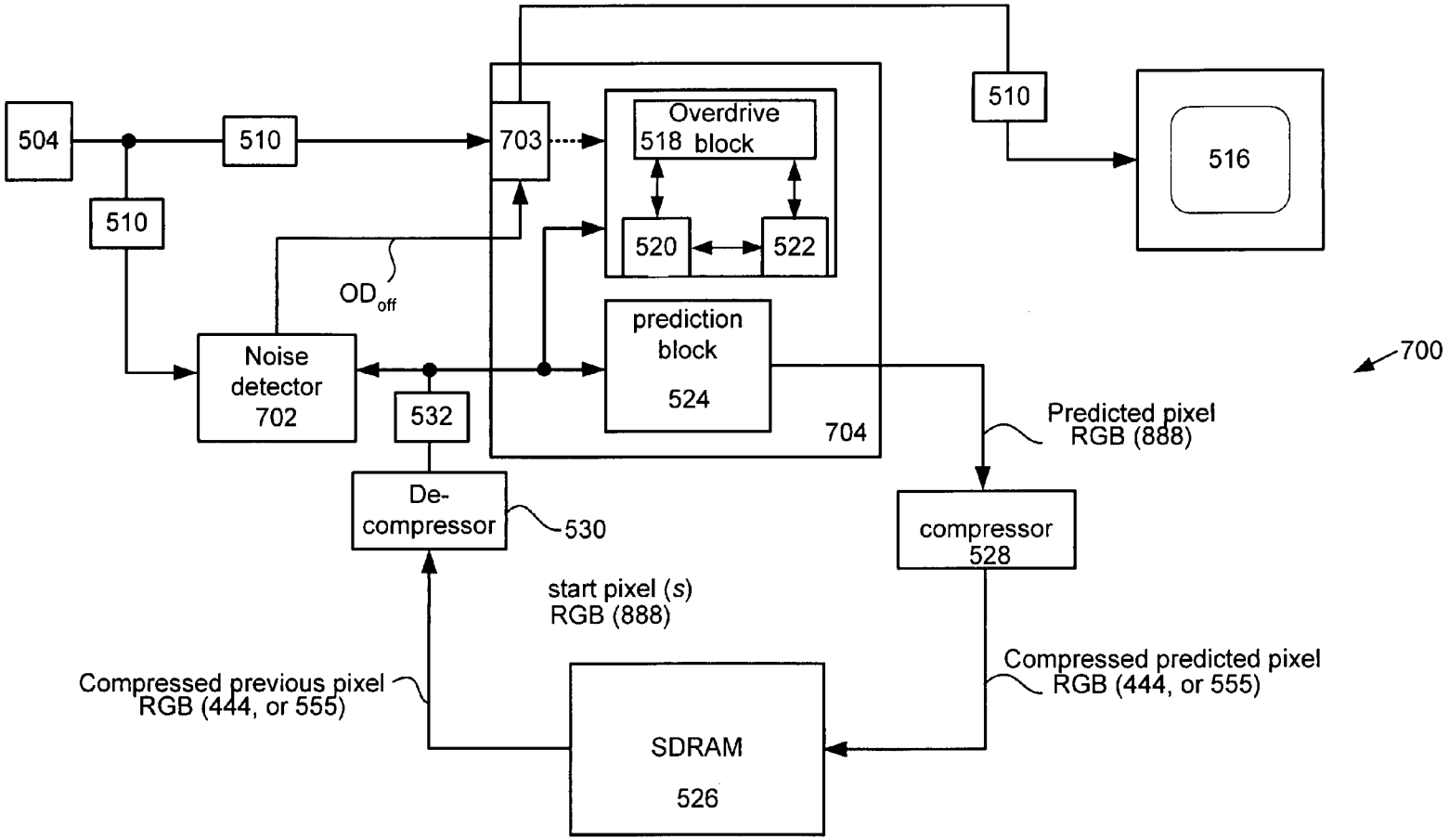

On the other hand, if the detected relative noise level is less than or equal to the predetermined threshold value as shown in FIG. 8, then an signal $OD_{off}$ directs the switch 703 to bypass the overdrive unit 704 such that the target pixel 510 is routed directly to the display 516. In this way, only those pixels having a relatively high noise level (indicative of fast motion) are processed by the overdrive unit 704 for display thereby reducing the image degradation caused by image artifacts related to data truncation and/or other low level noise sources.

It should be noted, however, that regardless whether or not the target pixel 510 is overdriven, the overdrive unit 704 still operates to generate a predicted pixel value and, in turn, the start pixel 532. In this way, when the detector signal OD switches from $Od_{off}$ to $OD_{on}$, then all the requisite data will be available for overdriving the then current pixel.

Figure 9:
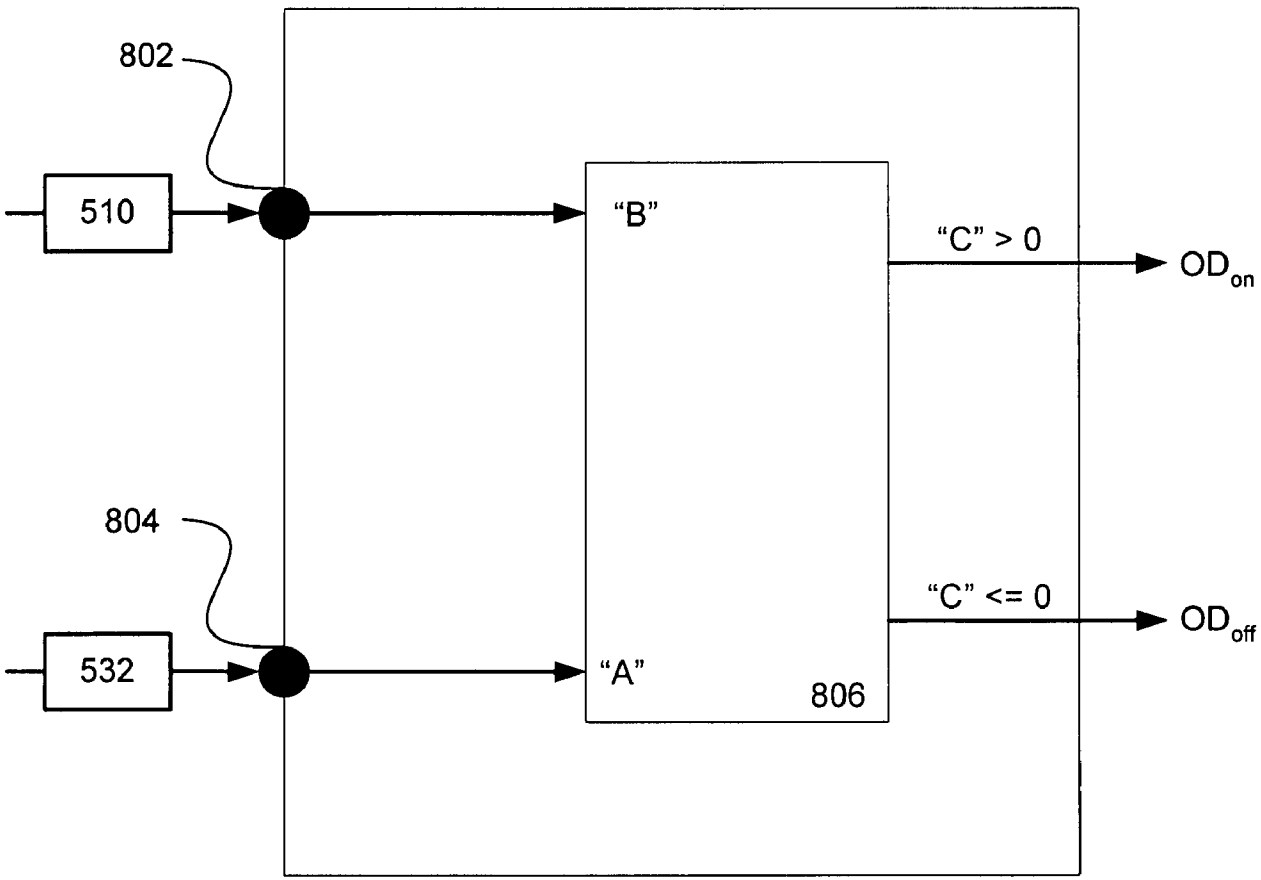
FIG. 9 shows a representative implementation of the noise detector in accordance with an embodiment of the invention.

FIG. 9 shows a representative implementation of the noise detector 702 in accordance with an embodiment of the invention. In the described embodiment, the noise detector 702 includes input nodes 802 and 804 for receiving the target pixel 510 of the current frame and the adjusted start pixel 532 of the next frame, respectively, coupled to a comparator unit 806 that provides either of the overdrive signals $OD_{on}$ or $OD_{off}$. During operation, the adjusted start pixel 532 (as "A", for example) and the target pixel 510 (as "B", for example) are compared as C=A−B when A>B and C=B−A when B>A such that when C>0, then the overdrive signal is $OD_{on}$ (i.e., perform LCD overdrive) and when C≦0 then the overdrive signal is $OD_{off}$ (i.e., don't perform LCD overdrive).

Figure 10:
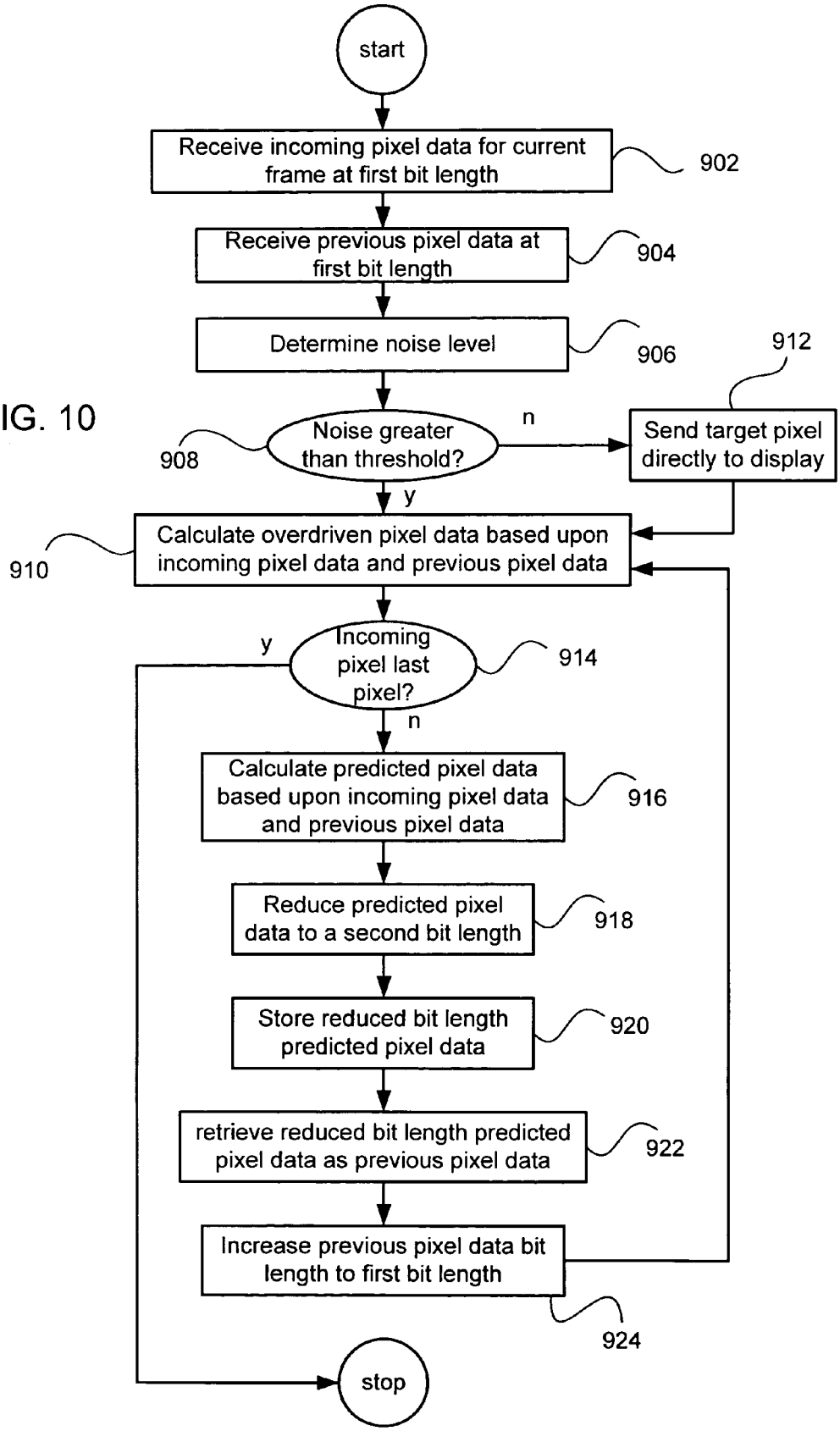
FIG. 10 shows a flowchart detailing a process for providing a reduced memory LCD overdrive in accordance with an embodiment of the invention.

FIG. 10 shows a flowchart detailing a process 900 for providing a reduced memory LCD overdrive in accordance with an embodiment of the invention. The process 900 begins at 902 by receiving a current pixel having a target pixel value associated with a current video frame concurrently with receiving a previous pixel of a previous video frame having a start pixel value at 904. At 906, a noise detector determines a noise level by comparing the start pixel value to the target pixel value. If, at 908, the detected noise level is greater than a predetermined threshold value then, at 910, an overdrive pixel value is calculated based upon a target pixel value and the start pixel value. On the other hand, if the detected noise level is less than or equal to a predetermined threshold value, then the target pixel is sent directly at 912 to a display device without being overdriven.

In any case, at 914, a determination is made whether or not the current pixel is the last pixel of the digital video stream. If the current pixel is the last pixel, then processing ends otherwise a predicted pixel value is calculated based upon the start pixel value and the target pixel value at 916. At 918, the predicted pixel data word is reduced in size to a second bit length and at 920, the reduced size predicted pixel data word is stored in a memory unit as the previous pixel data. At 922, the reduced size predicted pixel data is retrieved and at 924 is increased in size back to the first bit length prior to being provided as input the overdrive unit.

Figure 11:
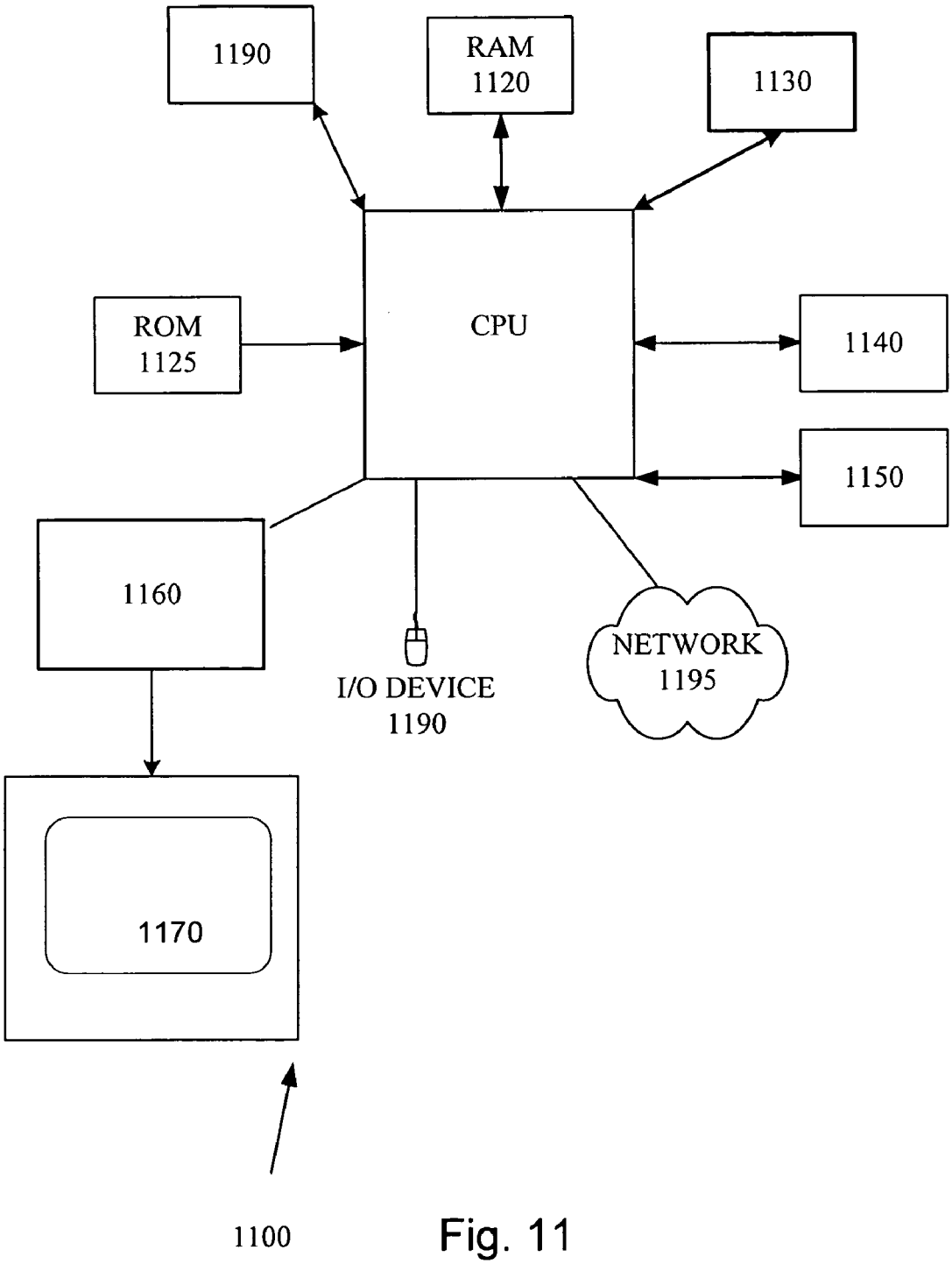
FIG. 11 illustrates a computer system employed to implement the invention.

FIG. 11 illustrates a system 1100 employed to implement the invention. Computer system 1100 is only an example of a graphics system in which the present invention can be implemented. System 1100 includes central processing unit (CPU) 710, random access memory (RAM) 1120, read only memory (ROM) 1125, one or more peripherals 1130, graphics controller 1160, primary storage devices 1140 and 1150, and digital display unit 1170. CPUs 1110 are also coupled to one or more input/output devices 1190 that may include, but are not limited to, devices such as, track balls, mice, keyboards, microphones, touch-sensitive displays, transducer card readers, magnetic or paper tape readers, tablets, styluses, voice or handwriting recognizers, or other well-known input devices such as, of course, other computers. Graphics controller 1160 generates image data and a corresponding reference signal, and provides both to digital display unit 1170. The image data can be generated, for example, based on pixel data received from CPU 1110 or from an external encode (not shown). In one embodiment, the image data is provided in RGB format and the reference signal includes the $V_{SYNC}$ and $H_{SYNC}$ signals well known in the art. However, it should be understood that the present invention can be implemented with image, data and/or reference signals in other formats. For example, image data can include video signal data also with a corresponding time reference signal.

Although only a few embodiments of the present invention have been described, it should be understood that the present invention may be embodied in many other specific forms without departing from the spirit or the scope of the present invention. The present examples are to be considered as illustrative and not restrictive, and the invention is not to be limited to the details given herein, but may be modified within the scope of the appended claims along with their full scope of equivalents.

While this invention has been described in terms of a preferred embodiment, there are alterations, permutations, and equivalents that fall within the scope of this invention. It should also be noted that there are many alternative ways of implementing both the process and apparatus of the present invention. It is therefore intended that the invention be interpreted as including all such alterations, permutations, and equivalents as fall within the true spirit and scope of the present invention.

The invention claimed is:

1. A method of providing LC overdrive in an LCD device, comprising:

calculating an actual brightness of a pixel in a currently displayed video frame based on an overdrive pixel value generated for the pixel for the currently displayed video frame;

generating a predicted pixel value for the pixel for the currently displayed video frame based on the calculated actual brightness, a start pixel value for the pixel for the currently displayed video frame and a target pixel value for the pixel for the currently displayed video frame;

adjusting a start pixel value for the pixel in a next to be displayed frame based on the predicted pixel value, the adjusting of the start pixel value including compressing the predicted pixel value for the currently displayed video frame, storing the compressed predicted pixel value, retrieving the compressed predicted pixel value, and decompressing the compressed pixel value to provide the adjusted start pixel value for the next to be displayed video frame;

generating an overdrive pixel value for the pixel in the next to be displayed frame based on the adjusted start pixel value for the next to be displayed frame and a target pixel value for the pixel in the next to be displayed frame wherein the overdrive pixel value is generated using an extended overdrive function $$G_s(p) = \begin{cases} p - m(s), & p < m(s) \\ f_s^{-1}(p), & m(s) \le p \le M(s) \\ 255 + (p - M(s)), & p > M(s) \end{cases}$$

wherein m(s) is the minimum pixel value reachable in one frame time starting at the adjusted start pixel value and M(s) is the maximum pixel value reachable in one frame time starting at the adjusted start pixel value;

detecting a noise level difference between a current pixel and a previous pixel; and determining whether the noise level difference indicates truncation noise, slow motion/system noise, or fast motion;

if the noise level difference is greater than a threshold value, thereby indicating fast motion, providing the overdrive pixel value for the next to be displayed video frame to the pixel, otherwise providing the target pixel value for the next to be displayed video frame to the pixel.

2. The method as recited in claim 1, wherein the generating the LC overdrive comprises:

accessing an overdrive table;

interpolating, when necessary, the adjusted start pixel value and the target pixel value; and determining an overdrive pixel value for the pixel in the next to be displayed video frame based upon the interpolating when performed or the adjusted start pixel value and the target pixel value otherwise.

3. The method as recited in claim 1, wherein the storing the compressed predicted pixel value comprises:

writing the compressed predicted pixel value to a selected memory address location in a memory device.

4. The method as recited in claim 3, wherein the retrieving the compressed predicted pixel value comprises:

reading the compressed predicted pixel value from the memory device at the selected memory address.

5. The method as recited in claim 4 wherein the memory device is an SDRAM.

6. The method as recited in claim 1, wherein the compressing is selected from the group consisting of: truncating and rounding.

7. The method as recited in claim 1, wherein the uncompressed adjusted start pixel value for the next to be displayed video frame and the target pixel value for the next to be displayed video frame are each 24 bits in length wherein 8 bits correspond to a red luminance value, another 8 bits correspond to a blue luminance value, and still another 8 bits correspond to a green luminance value.

8. A system for providing LC overdrive in an LCD device, comprising:

an LCD overdrive unit comprising a predicted pixel value generator arranged to calculate an actual brightness of a pixel in a currently displayed video frame based on an overdrive pixel value generated for the pixel for the currently displayed video frame, and generate a predicted pixel value for the pixel for the currently displayed video frame based on the calculated actual brightness, a start pixel value for the pixel for the currently displayed video frame and a target pixel value for the pixel for the currently displayed video frame;

a data compression unit for compressing the predicted pixel value for the currently displayed video frame;

a delay device arranged to delay the compressed predicted pixel value at least one frame period;

a decompressor unit for decompressing the delayed compressed predicted pixel value to provide the adjusted start pixel value for the next to be displayed video frame; and an overdrive pixel value generator unit arranged to generate an overdrive pixel value for the pixel in the next to be displayed frame based on the adjusted start pixel value for the next to be displayed frame and a target pixel value for the pixel in the next to be displayed frame wherein the overdrive pixel value is generated using an extended overdrive function $$G_s(p) = \begin{cases} p - m(s), & p < m(s) \\ f_s^{-1}(p), & m(s) \le p \le M(s) \\ 255 + (p - M(s)), & p > M(s) \end{cases}$$

wherein m(s) is the minimum pixel value reachable in one frame time starting at the adjusted start pixel value and M(s) is the maximum pixel value reachable in one frame time starting at the adjusted start pixel value; and a noise detector unit coupled with the decompressor unit for detecting a noise level difference between a current pixel and a previous pixel and determining whether the noise level difference indicates truncation noise, slow motion/system noise, or fast motion wherein if the noise level difference is greater than a threshold value, thereby indicating fast motion, providing the overdrive pixel value for the next to be displayed video frame to the pixel, otherwise providing the target pixel value for the next to be displayed video frame to the pixel.

9. The system as recited in claim 8, wherein the LCD overdrive unit further comprises:

an overdrive table having a number of data rows and data columns for enumerating a particular overdrive pixel value for a particular adjusted start pixel value, target pixel value pair coupled to the overdrive pixel value generator; and an interpolator unit coupled to the overdrive table and the overdrive pixel generator for interpolating between either or both of the particular adjusted start pixel value and the target pixel value when either or both of the particular adjusted start pixel value or the target pixel value are not one of a number of tabulated pixel values.

10. The system as recited in claim 8, wherein the delay device is a memory unit.

11. The system as recited in claim 10, wherein the memory device is a SDRAM memory device.

12. The system as recited in claim 8, wherein the data compressor unit truncates the predicted pixel value a selected number of bits.

13. The system as recited in claim 8, wherein the data compressor unit rounds off the predicted pixel value to a selected number of bits.

14. Computer program product stored on a computer readable medium for providing LC overdrive in an LCD device, comprising:

computer code for calculating an actual brightness of a pixel in a currently displayed video frame based on an overdrive pixel value generated for the pixel for the currently displayed video frame;

computer code for generating a predicted pixel value for the pixel for the currently displayed video frame based on the calculated actual brightness, a start pixel value for the pixel for the currently displayed video frame and a target pixel value for the pixel for the currently displayed video frame;

computer code for adjusting a start pixel value for the pixel in a next to be displayed frame based on the predicted pixel value, the computer code for adjusting the start pixel value including computer code for compressing the predicted pixel value, computer code for storing the compressed predicted pixel value, computer code for retrieving the compressed predicted pixel value, and computer code for decompressing the compressed pixel value to provide the adjusted start pixel value for the next to be displayed video frame;

computer code for generating an overdrive pixel value for the pixel in the next to be displayed frame based on the adjusted start pixel value for the next to be displayed frame and the target pixel value for the pixel in the next to be displayed frame wherein the overdrive pixel value is generated using an extended overdrive function $$G_s(p) = \begin{cases} p - m(s), & p < m(s) \\ f_s^{-1}(p), & m(s) \le p \le M(s) \\ 255 + (p - M(s)), & p > M(s) \end{cases}$$

wherein m(s) is the minimum pixel value reachable in one frame time starting at the adjusted start pixel value and M(s) is the maximum pixel value reachable in one frame time starting at the adjusted start pixel value; and computer code for detecting a noise level difference between a current pixel and a previous pixel, computer code for determining whether the noise level difference indicates truncation noise, slow motion/system noise, or fast motion;

computer code for determining if the noise level difference is greater than a threshold value, thereby indicating fast motion, computer code for providing the overdrive pixel value for the next to be displayed video frame to the pixel only if the difference is greater than the threshold value, and computer code for providing the target pixel value for the next to be displayed video frame to the pixel otherwise.

15. The computer program product as recited in claim 14, wherein the computer code for generating the LC overdrive comprises:

computer code for accessing an overdrive table;

computer code for interpolating, when necessary, the adjusted start pixel value and the target pixel value; and computer code for determining an LC overdrive pixel value for the pixel in the next to be displayed video frame based upon the interpolating when performed or the adjusted start pixel value and the target pixel value otherwise.

16. The computer program product as recited in claim 14, wherein the computer code for storing the compressed predicted pixel value comprises:

computer code for writing the compressed predicted pixel value to a selected memory address location in a memory device.

17. The computer program product as recited in claim 16, wherein the computer code for retrieving the compressed predicted pixel value comprises:

computer code for reading the compressed predicted pixel value from the memory device at the selected memory address.

18. The computer program product as recited in claim 17 wherein the memory device is an SDRAM.

19. The computer program product as recited in claim 17, wherein the compressing is selected from the group consisting of: truncating and rounding.

20. The computer program product as recited in claim 14, wherein the uncompressed adjusted start pixel value for the next to be displayed video frame and the target pixel value for the next to be displayed video frame are each 24 bits in length wherein 8 bits correspond to a red luminance value, another 8 bits correspond to a blue luminance value, and still another 8 bits correspond to a green luminance value.

* * * * *